US007520544B2

(12) United States Patent
Cutrer

(10) Patent No.: US 7,520,544 B2
(45) Date of Patent: Apr. 21, 2009

(54) HOME SECURITY HINGE AND STRIKER PLATE SYSTEM

(76) Inventor: Robert E. Cutrer, 115 Zinnia St., Lake Jackson, TX (US) 77566

( * ) Notice: Subject to any disclaimer, the term of this patent is extended or adjusted under 35 U.S.C. 154(b) by 0 days.

(21) Appl. No.: 11/367,842

(22) Filed: Mar. 4, 2006

(65) Prior Publication Data

US 2007/0205616 A1 Sep. 6, 2007

(51) Int. Cl.
*E05B 15/02* (2006.01)

(52) U.S. Cl. ..... 292/341.14; 292/340; 49/504

(58) Field of Classification Search ..... 292/340, 292/341, 341.14, 341.19; 16/392; 49/460, 49/504

See application file for complete search history.

(56) References Cited

U.S. PATENT DOCUMENTS 3,559,704 A * 2/1971 Thompson ..... 144/144.51
RE31,276 E * 6/1983 Schlage ..... 292/340
4,656,691 A * 4/1987 Allen ..... 16/251
4,867,496 A * 9/1989 Thomas ..... 292/341.16
4,984,613 A * 1/1991 Szeto et al. ..... 144/27
5,570,917 A * 11/1996 Cutrer ..... 292/346
6,123,370 A * 9/2000 Rozema et al. ..... 292/47
6,679,004 B1 * 1/2004 Olberding et al. ..... 49/460
6,837,527 B1 * 1/2005 Laurenzana ..... 292/340
6,901,706 B2 * 6/2005 Olberding et al. ..... 49/460

* cited by examiner

*Primary Examiner*—Gary Estremsky
(74) *Attorney, Agent, or Firm*—Warner J. Delaune; Baker Donelson, et al.

(57) ABSTRACT

A striker plate assembly and security hinge system for use between a door and a door casing is provided, comprising a striker plate having a face plate and a housing adapted to receive an extendible member from the door, and a reinforcing member comprising a first flange having an opening adapted to matably and interlockingly engage said housing of the striker plate, and a second flange having a first hole pattern. The system also includes at least two security hinge assemblies connected between the door, the door casing and the interior wall structure, wherein each security hinge assembly comprises first and second hinging plates operatively connected by a pin, wherein the first hinging plate is attached to the door and includes a backstop plate, and wherein the second hinging plate includes an anchoring plate attached to the interior wall structure. Optionally, a routing guide may be employed which assists in the formation of a slot for the security hinges through the door casing.

9 Claims, 4 Drawing Sheets

HOME SECURITY HINGE AND STRIKER PLATE SYSTEM

BACKGROUND OF THE INVENTION

I. Field of the Invention

The present invention relates generally to door security hardware systems that will prevent the door casing from failure in the event of an attempted forced entry, and more particularly to such systems which form a rigid and interlocking relationship in combination with an interior wall structure.

II. Background and Prior Art

As is well known in the art, conventional door assemblies are comprised of a hinged door residing within a casing nailed to an interior wall structure. The door latch engages a striker plate which is typically attached to the casing by a pair of screws. If a dead bolt lock is also employed, the bolt engages its own striker plate attached to the casing in a similar manner as the door latch striker plate. In most conventional door assemblies, the casing is about ¾ inch thick, which means that the thin metal striker plate or the casing itself may not be sufficient to withstand an attempted forced entry.

Numerous designs have been proposed over the years which are directed to improving the strength of conventional door assemblies. One disadvantage to many of the designs is that they are intended for installation with original construction, i.e. when the home is being built, because the alternative hardware is easier to install when the interior wall structure is exposed. Another disadvantage is that many security hardware systems are bulky and unsuitable for home use where traditional trim molding and other decorative features are desired by the homeowner. A third disadvantage is that such security hardware may be difficult to install for the typical "do it yourself" homeowner.

In my prior invention, described in U.S. Pat. No. 5,570,917, a security system was provided which employed an elongated rod member extending from the striker plate into the wall studs. A reinforcing plate was attached to the wall studs across the door casing to further fortify the assembly against a forced entry attempt. Since forced entry may also result from failure on the hinge side of the door, a reinforcing hinge plate was also provided. Rather than attaching the hinge plate directly to the casing, a reinforcing flange was employed to mount directly to the interior side of the wall studs.

Despite the advantages and success of that design, that system was not designed with the average homeowner in mind. Therefore, there is a need for a door security system which remains inexpensive, easy to install, and no less effective in withstanding the sudden and intense impact of a forced entry attempt.

SUMMARY OF THE INVENTION

Therefore, one object of the present invention is to provide a home security striker plate which reinforces the engagement of a closed door within a casing.

It is also an object of the present invention to provide a home security striker plate which is easy to install beneath existing door trim molding.

Still another object of the present invention is to provide a home security striker plate which can be employed for either a standard door latch or a dead bolt lock.

Another object of the present invention is to provide a home security hinge system which reinforces the hinged connection of a door within a casing.

Yet another object of the present invention is to provide a home security hinge system which allows quick and easy modification of the casing by the use of a routing guide.

A further object of the present invention is to provide a retrofitting kit which includes one or more interlocking striker plates, two or more interlocking hinges, and a routing guide.

Accordingly, a home security system for reinforcing a door is provided, comprising a striker plate assembly for use between a door and a door casing, comprising a striker plate having a face plate and a housing adapted to receive an extendible member from the door; and a reinforcing member comprising a first flange having an opening adapted to matably and interlockingly engage said housing of the striker plate, and a second flange having a first hole pattern. The striker plate assembly further includes a shim plate having a second hole pattern adapted to matably engage the first hole pattern of the second flange of the reinforcing member. Preferably, the first hole pattern comprises at least two holes adapted to receive mounting screws.

Also provided is a security hinge and striker plate system within a door assembly, comprising a striker plate assembly as described above, and at least two security hinge assemblies connected between the door, the door casing and the interior wall structure, wherein each security hinge assembly includes first and second hinging plates operatively connected by a pin, wherein the first hinging plate is attached to the door and includes a backstop plate, and wherein the second hinging plate includes an anchoring plate attached to the interior wall structure.

Finally, a retrofitting kit for installation to a door and casing is provided, wherein the kit includes the interlocking striker plate assembly and security hinges described above, as well as a routing guide matably engageable with the door casing, wherein the routing guide includes a base plate, a casing rest member on a bottom surface of the base plate, and a guide slot formed through the base plate, wherein the guide slot is positioned within a predetermined distance from the casing rest member. Preferably, the routing guide further includes a raised edge extending from a top surface of the base plate as a guide for a router. The routing guide may further include a visual indicia to indicate a predetermined location along the guide slot.

DETAILED DESCRIPTION OF THE PREFERRED EMBODIMENTS

Certain features which are used in assembling or operating the invention, but which are known to those of ordinary skill in the art and not bearing upon points of novelty, such as screws, bolts, nuts, welds, and other common fasteners, may not be shown for clarity.

Figure 1:
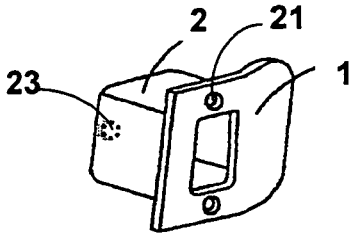
FIG. 1 is a perspective view of a door latch bolt striker plate.
Figure 2:
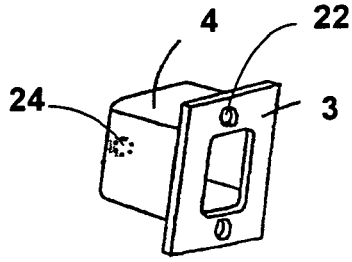
FIG. 2 is a perspective view of a dead bolt striker plate.
Figure 3:
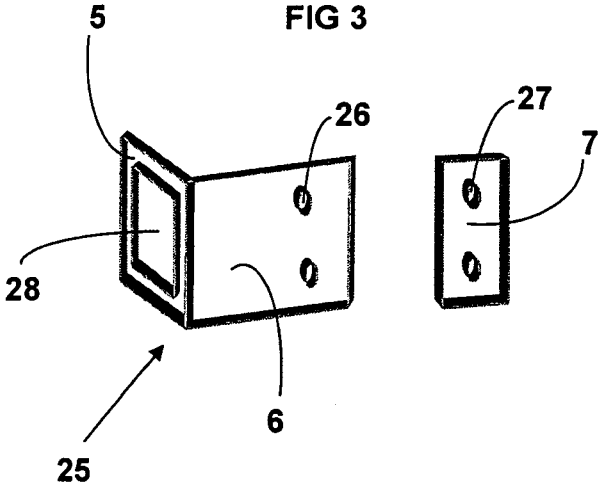
FIG. 3 is a perspective view of the interlocking reinforcement member of the present invention and the optional shim which may be used depending on the wall thickness.

Turning now to FIGS. 1 and 2, the latch bolt and dead bolt striker plates, respectively, of the present invention are shown. In the case of FIG. 1 depicting the latch bolt striker plate, the striker plate includes a partially curved face plate 1 with an attached housing 2 or enclosed space which accepts a door latch. In the case of FIG. 2, depicting the dead bolt striker plate, the striker plate similarly includes a flat face plate 3 and an attached housing 4 which accepts a dead bolt. For the purposes herein, the latch bolt or the dead bolt may be referred to as an extendible member which engages the striker plate. In both cases, mounting holes 21, 22 are formed into each face plate 1, 2, respectively, for attaching the striker plates in a recessed manner to a corresponding opening in a door casing 13A. Typically, an additional hole 23, 24 is included in the back surface of the housings 2, 4, respectively, for the additional of a long threaded fastener (not shown) into the wall stud 14A behind the casing 13A.

In the present invention, a reinforcing member 25 is also provided comprising a first flange 5 having an opening 28 adapted to matably and interlockingly engage the housing 2, 4 of the striker plate, and a second flange 6 having a first hole pattern 26. The striker plate assembly may further include a shim plate 7 having a second hole pattern 27 adapted to matably engage the first hole pattern 26 of the second flange 6 of the reinforcing member 25. Preferably, the first hole pattern 26 comprises at least two holes adapted to receive mounting screws. As more fully illustrated in FIG. 5, only the striker plate system for the door latch bolt of FIG. 1 is shown, but with the understanding that the dead bolt striker plate of FIG. 2 is installed and functions in a substantially identical manner. The housing 2 is passed through the door casing 13A, and then through the opening 28 of the first flange 5 of the reinforcing member 25. This interlocking engagement is critical to the function of the invention. In a preferred embodiment, the face plate 1 is secured into place with two 4" screws which extend through the door casing 13A and into the interior wall structure 14A, sometimes referred to herein as the wall studs. Also, another 3" screw is mounted through the hole 23 in the back of the housing 2 into the stud 14A. Screws are then used to fasten the second flange 6 of the reinforcing member 25 to the wall stud 14A. Depending upon the particular wall thickness, a shim 7 may be used to compensate for any gap appearing between the second flange 6 and the wall. In practice, a variety of shim 7 sizes may be provided to accommodate varying gap sizes which may be present. Once the striker plate, reinforcing member 25, and any necessary shims 7 are installed, conventional door trim molding will conceal the assembly, for it is designed so that the second flange 6 is not to extend past the designated area of the trim molding. Thus, in the assembled configuration shown in FIG. 5, the door casing 13A is made strong enough to withstand the pressure of a forced entry attempt that would normally cause the door casing 13A to fail.

Figure 4:
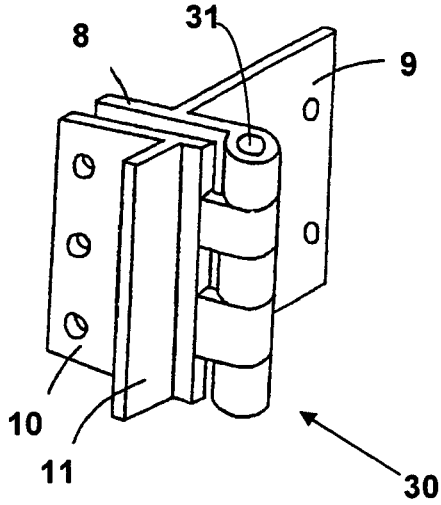
FIG. 4 is a perspective view of the interlocking hinge of the present invention.
Figure 5:
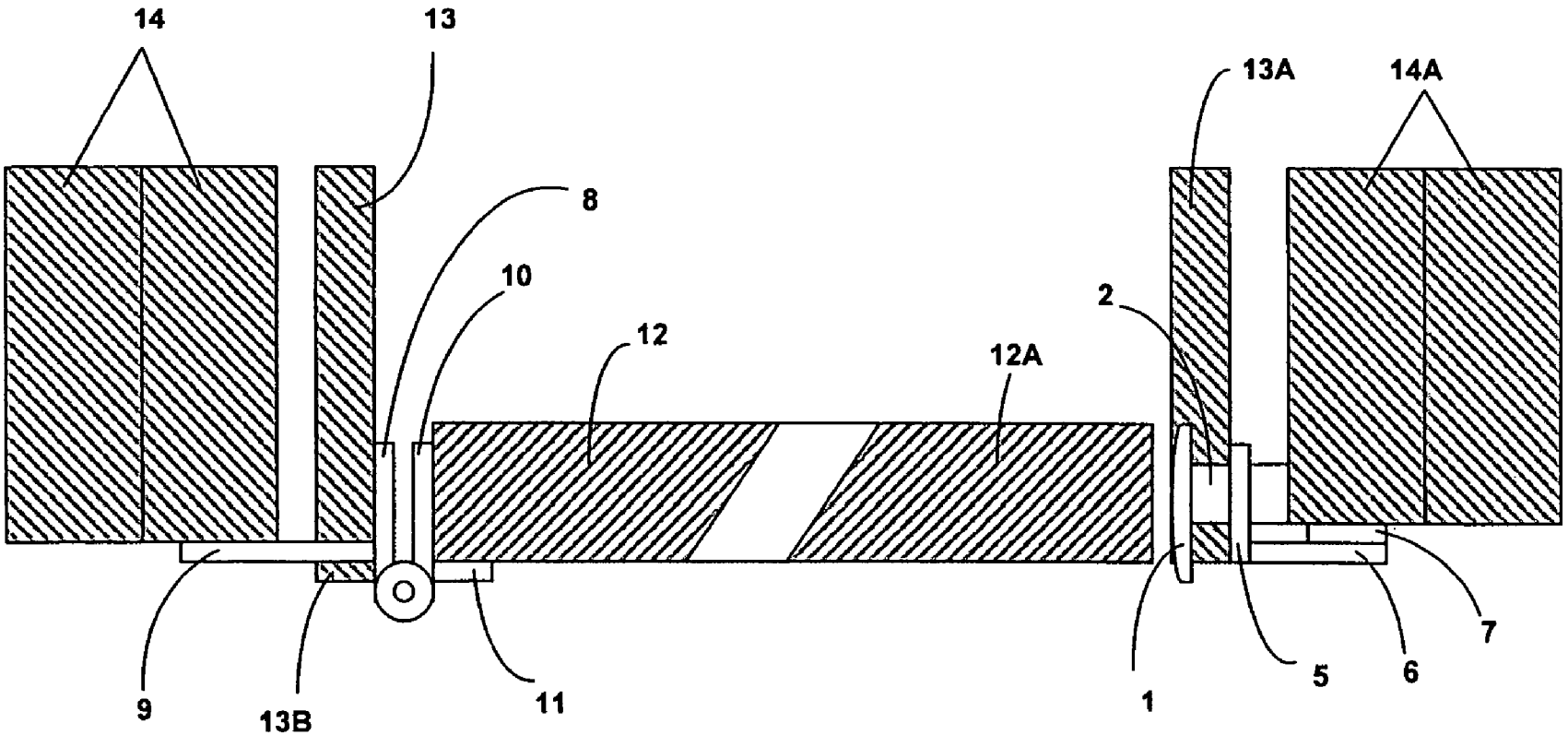
FIG. 5 is a top cross-sectional view of a preferred embodiment of the present invention shown in an installed configuration.

Referring now to FIGS. 4 and 5, the security hinge assembly 30 is described. Each hinge assembly 30 comprises first hinging plate 10 and a second hinging plate 8 connected to one another by a pin 31, wherein the first hinging plate 10 is attached to the door 12 and includes a backstop plate 11, and wherein the second hinging plate 8 includes an anchoring plate 9 attached to the interior wall structure or stud 14. The second hinging plate 8 also includes a plurality of mounting holes for attachment to the door casing 13. The hinge assembly 30 is designed to interlock into the wall interior structure 14 by slotting the door casing 13, to allow the anchoring plate 9 to extend through the door casing 13 and mount securely to the wall interior structure 14. Before the anchoring plate 9 is secured, it is necessary for the second hinging plate 8 to be properly recessed into the hinge side of the door casing 13. Once the second hinging plate 8 is properly recessed, the anchoring plate 9 can be anchored into place with 3" screws into the wall interior structure 14. Thus, once the anchoring plate 9 is anchored into place, the second hinging plate 8 can be secured into place with the 4" screws so they will extend past the door casing 13 and will screw into the wall interior structure 14. The anchoring plate 9 will be concealed with a door trim molding, for it is installed so that the door casing 13 is slotted to allow the anchoring plate 9 to be covered with the door casing 13B (best shown in FIG. 5). The anchoring plate 9 is also designed not to extend past the designated area for the trim molding, so that once the door trim molding is installed the anchoring plate 9 will be completely concealed, thus imparting a standard and normal appearance to the interior of the door frame.

Figure 6:
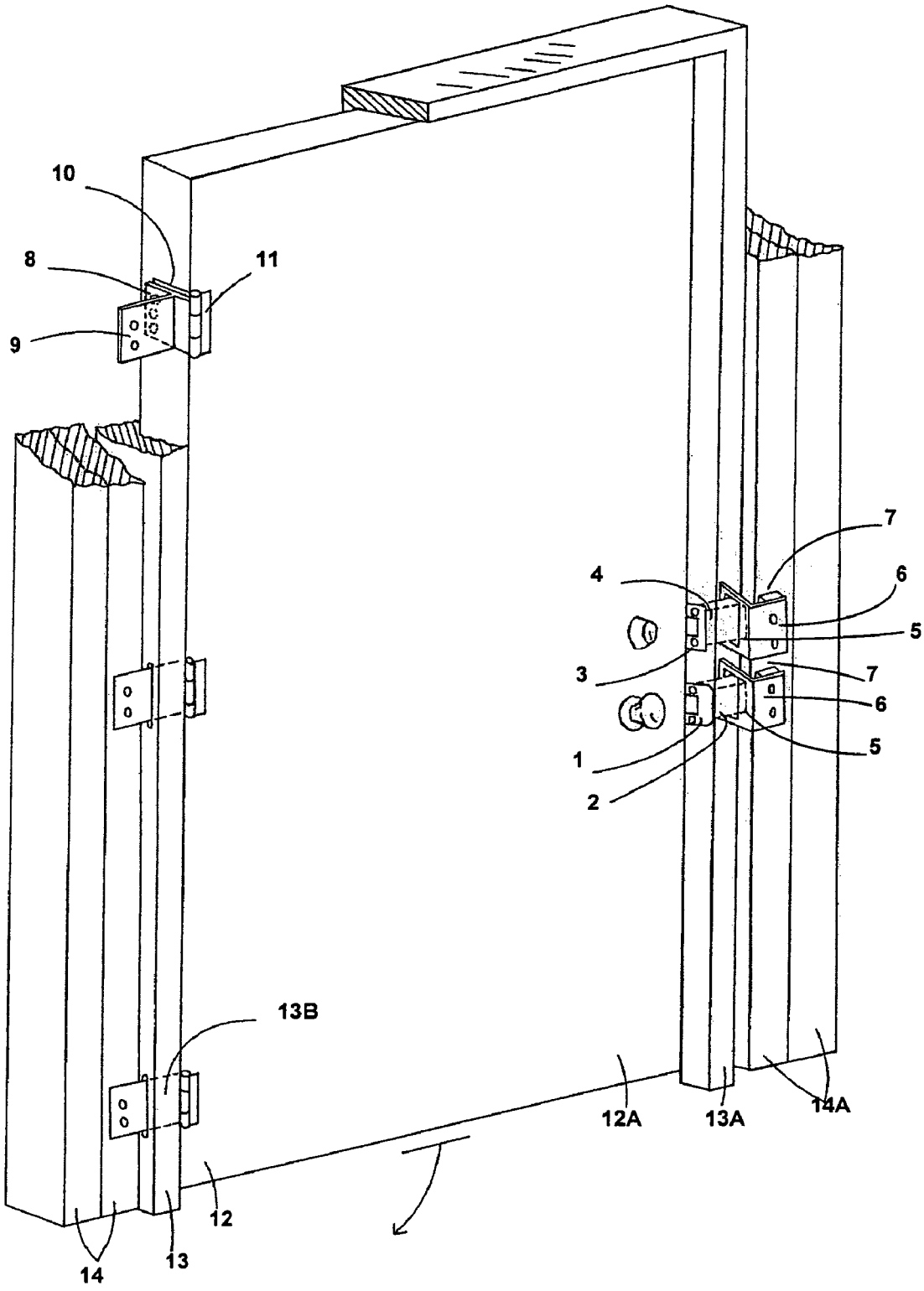
FIG. 6 is a perspective view of the preferred embodiment of the present invention depicting the latch bolt and dead bolt striker plates, as well as the interlocking hinges in an installed configuration.

On the door side of the hinge assembly 30, the first hinging plate 10 remains secured to the hinge side of the door 12 in the normal and conventional manner, but with second hinging plate 8 being interlocked with the wall interior structure 14. Because of this innovative design, when force is applied to the door in the event of a forced entry attempt, there is a tendency for the screws to be pulled out of the door 12 itself (from the first hinging plate 10). For this reason, each security hinge assembly 30 includes the backstop plate 11. The presence of the backstop plate 11, shown best in FIG. 5, prevents the door 12 from being forced away, relative to first hinging plate 10, when pressure is applied. Thus, the backstop plate 11 reduces the reliance upon the screws through the first hinging plate 10 to withstand such forces. As will be appreciated, the combination of the anchoring plate 9 providing a rigid connection of the second hinging plate 8 to the wall interior structure 14, and the door backstop plate 11 preventing the door from being forced back, provides a clearly superior security arrangement for the door casing 13 that is strong enough to withstand the pressure that would normally cause the door casing 13 to fail. FIG. 6 provides a fully assembled view of the present invention within a door frame, which further illustrates why the aforementioned components serve to provide substantially enhanced security for the homeowner.

Figure 7:
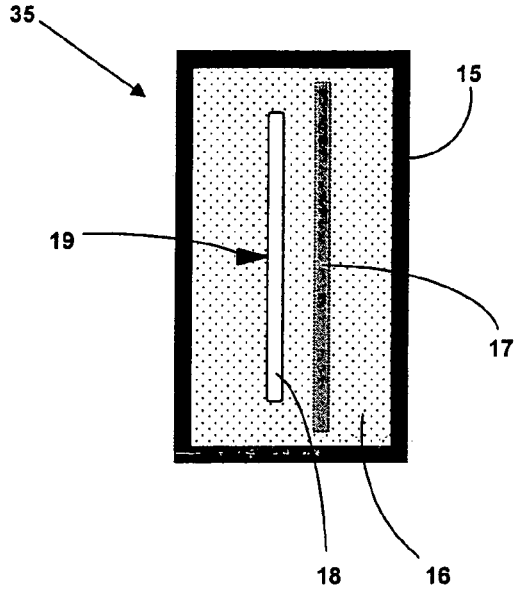
FIG. 7 is an elevation view of a preferred embodiment of the routing guide for forming the slot in the casing for the interlocking hinges.
Figure 8:
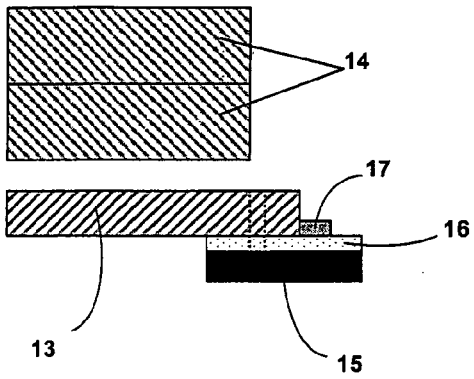
FIG. 8 is a top cross-sectional view of the routing guide of FIG. 7 placed in the proper position against the casing prior to forming the slot for an interlocking hinge.
Figure 9:
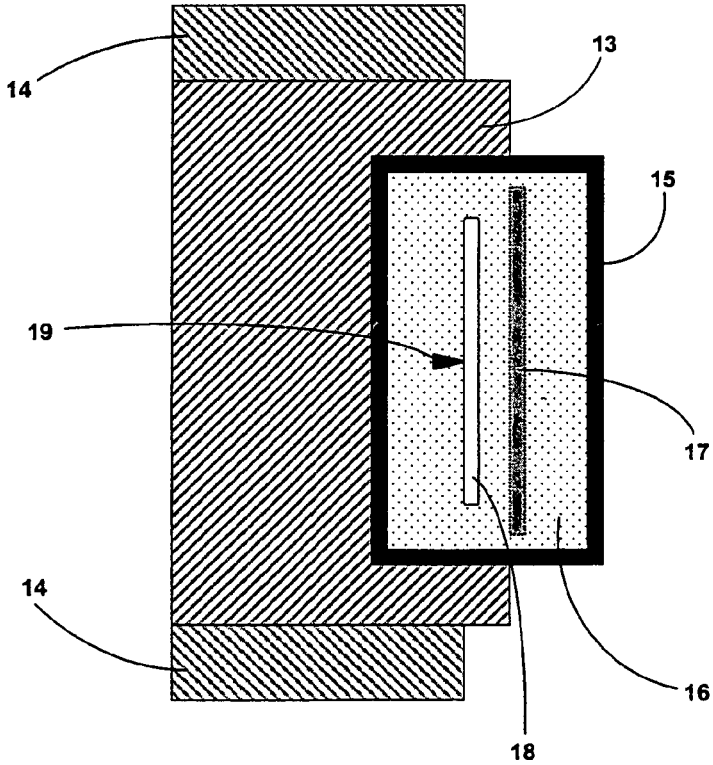
FIG. 9 is an elevation view of the routing guide of FIG. 7 placed in the proper position against the casing relative to the location of the wall studs.

The components of the present invention may also be provided in the form of a kit, specifically a home security retrofit kit for reinforcing a door within a door casing. In a preferred embodiment, the kit should include three primary components. First, the kit should include a striker plate assembly, including a striker plate having a face plate 1 and a housing 2 adapted to receive an extendible member from a door 12, as well as the reinforcing member 25, including a first flange 5 having an opening 28 adapted to matably and interlockingly engage the housing 2 of the striker plate, and a second flange 6 having a hole pattern 26. The optional shims 7 should also be included to accommodate a variety of wall thicknesses. Second, the kit should also include at least two of the security hinge assemblies described above, and preferably at least three such hinges for most heavy outside doors. Finally, the kit should include a routing guide 35 for properly forming the slot required for installation of the hinges 30 through the door casing 13, as best illustrated in FIGS. 7-9. The routing guide 35 includes a base plate 16, a casing rest member 17 on a bottom surface of the base plate 16, and a guide slot 18 formed through the base plate 16. The routing guide 35 should be matably engageable with the door casing 13, such that the guide slot 18 is positioned within a predetermined distance from the casing rest member 17. Preferably, the routing guide 35 further includes a raised edge 15 extending from a top surface of the base plate 16 as a guide for a router. The routing guide 35 may further include a visual indicia 19, such as an arrow or other suitable sign, to indicate a predetermined location along the guide slot 18 for aligning the guide slot 18 in the proper horizontal and vertical positions.

Although exemplary embodiments of the present invention have been shown and described, many changes, modifications, and substitutions may be made by one having ordinary skill in the art without necessarily departing from the spirit and scope of the invention.

I claim:

1. A striker plate assembly attached to a door assembly that includes a door and a door casing and at least one wall stud, comprising:

(a) a striker plate having a face plate and an enclosed housing adapted to receive an extendible member from said door, wherein said striker plate is attached to said door casing by a first plurality of screws; and (b) a reinforcing member comprising a first flange parallel to said face plate having an opening adapted to matably and interlockingly surround and engage said housing of said striker plate, and a second flange perpendicular to said first flange having a first hole pattern, wherein said second flange of said reinforcing member is attached to said wall stud by a second plurality of screws.

2. The striker plate assembly of claim 1, further including a shim plate having a second hole pattern adapted to matably engage said first hole pattern of said second flange of said reinforcing member.

3. The striker plate of claim 1, wherein said first hole pattern comprises at least two holes adapted to receive mounting screws.

4. In a door assembly comprising a door, a substantially rigid interior wall structure, and a door casing, wherein said door casing is attached to said interior wall structure, a security hinge and striker plate system, comprising:

(a) a striker plate assembly, including a striker plate having a face plate and an enclosed housing adapted to receive an extendible member from said door, wherein said striker plate is attached to said door casing by a first plurality of screws; and a reinforcing member, including a first flange parallel to said face plate having an opening adapted to matably and interlockingly surround and engage said housing of said striker plate, and a second flange perpendicular to said first flange having a first hole pattern, wherein said second flange of said reinforcing member is attached to a wall stud by a second plurality of screws;

(b) at least two security hinge assemblies connected between said door, said door casing and said interior wall structure, wherein each said security hinge assembly comprises: first and second hinging plates operatively connected by a pin, wherein said first hinging plate is attached to said door and includes a backstop plate, and wherein said second hinging plate includes an anchoring plate attached to said interior wall structure.

5. The security hinge and striker plate system of claim 4, further including a shim plate having a second hole pattern adapted to matably engage said first hole pattern of said second flange of said reinforcing member.

6. The security hinge and striker plate system of claim 4, wherein said first hole pattern comprises at least two holes adapted to receive mounting screws.

7. A home security retrofit kit for reinforcing a door within a door casing, comprising:

(a) a striker plate assembly, including a striker plate having a face plate and an enclosed housing adapted to receive an extendible member from a door, wherein said striker plate is attached to a door casing by a first plurality of screws; and a reinforcing member, including a first flange parallel to said face plate having an opening adapted to matably and interlockingly surround and engage said housing of said striker plate, and a second flange perpendicular to said first flange having a hole pattern, wherein said second flange of said reinforcing member is attached to a wall stud by a second plurality of screws;

(b) at least two security hinge assemblies wherein each said security hinge assembly comprises first and second hinging plates operatively connected by a pin, wherein said first hinging plate includes a backstop plate, and wherein said second hinging plate includes an anchoring plate; and (c) a routing guide matably engageable with a door casing, wherein said routing guide includes a base plate, a casing rest member on a bottom surface of said base plate, and a guide slot formed through said base plate, wherein said guide slot is positioned within a predetermined distance from said casing rest member.

8. The retrofit kit of claim 7, wherein said routing guide further includes a raised edge extending from a top surface of said base plate as a guide for a router.

9. The retrofit kit of claim 7, wherein said routing guide further includes a visual indicia to indicate a predetermined location along said guide slot.

* * * * *